US006917145B2

(12) United States Patent
Fischer et al.

(10) Patent No.: US 6,917,145 B2
(45) Date of Patent: Jul. 12, 2005

(54) SPARK PLUG

(75) Inventors: Jochen Fischer, Bamberg (DE); Andreas Benz, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 132 days.

(21) Appl. No.: 10/344,904

(22) PCT Filed: Jun. 14, 2002

(86) PCT No.: PCT/DE02/02169

§ 371 (c)(1),
(2), (4) Date: Aug. 19, 2003

(87) PCT Pub. No.: WO02/103869

PCT Pub. Date: Dec. 27, 2002

(65) Prior Publication Data

US 2004/0041505 A1 Mar. 4, 2004

(30) Foreign Application Priority Data

Jun. 15, 2001 (DE) ..... 101 29 040

(51) Int. Cl.[7] ..... H01T 13/20
(52) U.S. Cl. ..... 313/140; 313/141

(58) Field of Search ..... 313/140, 141

(56) References Cited

FOREIGN PATENT DOCUMENTS

| | | |
|---|---|---|
| DE | 196 23 989 | 1/1998 |
| FR | 784 679 | 7/1935 |
| JP | 9-129356 | 5/1997 |
| JP | 9-260025 | 10/1997 |
| JP | 2000-150108 | 5/2000 |

OTHER PUBLICATIONS

Patent Abstracts of Japan, vol. 1997, No. 09, Sep. 30, 1997.
Patent Abstracts of Japan, vol. 1998, No. 02, Jan. 30, 1998.
Patent Abstracts of Japan, vol. 2000, No. 08, Oct. 6, 2000.

*Primary Examiner*—Vip Patel
(74) *Attorney, Agent, or Firm*—Kenyon & Kenyon

(57) ABSTRACT

A spark plug includes at least one ground electrode with a reduced temperature level. The spark plug encompasses a tubular metallic housing that has, at the combustion-chamber end, an outer rim on which at least one ground electrode is positioned. The cross-sectional area of the at least one ground electrode increases toward the outer rim of the housing.

23 Claims, 4 Drawing Sheets

SPARK PLUG

FIELD OF THE INVENTION

The present invention relates to a spark plug.

BACKGROUND INFORMATION

German Published Patent Application No. 196 23 989 relates to a spark plug having a tubular metallic housing that has, at the combustion-chamber end, an outer rim to which preferably four ground electrodes are attached.

SUMMARY

The spark plug according to the present invention, in contrast thereto, provides that the cross-sectional area of the at least one ground electrode increases toward the outer rim of the housing. The temperature level of the at least one ground electrode may thereby be reduced. As a result, the at least one ground electrode is exposed to less wear, for example due to corrosion. In addition, surface ignition events or pre-ignition may be prevented.

The ground electrode may encompass at least one core that is more thermally conductive than a shell of the ground electrode surrounding the core. The temperature level of the ground electrode may thereby be additionally reduced, and the temperature resistance of the ground electrode thus may be further enhanced.

The ground electrode may have a round cross-sectional area. In this case the ratio between the surface area and the cross-sectional area of the ground electrode may be optimal in terms of a lowest possible temperature level, and thus a greatest possible temperature resistance, of the ground electrode.

A particularly simple implementation of the ground electrode may be achieved when the ground electrode encompasses a first part having a substantially constant cross-sectional area and a second part having a cross-sectional area increasing toward the outer rim of the housing.

The temperature level of the ground electrode may be further reduced if both the first part and the second part of the ground electrode each encompass a cross-sectional area increasing toward the outer rim of the housing.

The second part may be positioned on the outer rim of the housing and may encompass an opening through which the first part is guided, for example as far as the outer rim of the housing. In this manner the heat flux from the ground electrode may be brought with less thermal resistance into the colder housing of the spark plug.

The second part may be a trapezoidal configuration and, in the region of the outer rim of the housing, may assume the radius of the housing. In this manner the second part of the ground electrode may be joined positively to the outer rim of the housing or, in particularly simple fashion from a production-engineering standpoint, may be stamped or machined out of an extension at the combustion-chamber end.

Production-engineering complexity may also be eliminated by the fact that the ground electrode having the two parts is produced in one piece, e.g., by punching or cold extrusion.

Production may also be less complex if the first part and the second part are made of the same material.

DETAILED DESCRIPTION

Figure 1:
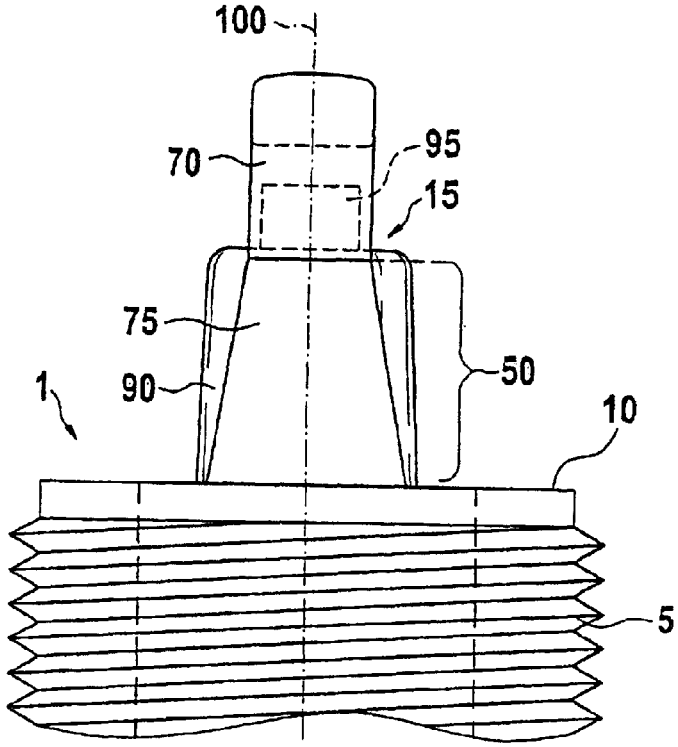
FIG. 1 is a front view of a first exemplary embodiment of a spark plug according to the present invention.

In FIG. 1, a spark plug is labeled 1. Spark plug 1 encompasses a tubular metallic housing 5 that has an outer rim 10 at the combustion-chamber end. Embedded in housing 5 is an insulator 90 from which a center electrode 95 projects at the combustion-chamber end. Center electrode 95, insulator 90, and tubular metallic housing 5 are coaxial with one another. Insulator 90 of center electrode 95 projects from housing 5 at the combustion-chamber end. In the side view illustrated in FIG. 2, a ground electrode 15 is attached to outer rim 10 of housing 5. This electrode initially extends parallel to longitudinal axis 100 of spark plug 1. Ground electrode 15 is then bent over toward center electrode 95, and guided over end surface 105 of center electrode 95. Ground electrode 15 is thus embodied, in this example, as a top electrode.

According to the first exemplary embodiment, spark plug 1 encompasses exactly one ground electrode. The spark plug according to the present invention may, however, also encompass multiple ground electrodes.

Ground electrodes reach high temperatures, depending on the operating state. High temperatures result in increasing wear on the ground electrodes due to corrosion, and may result in surface ignition events or pre-ignition. New engine concepts may require increasingly long spark positions advanced into the combustion chamber, which may thus require even greater ground electrode lengths. The temperature stress on the ground electrodes thus increases.

Provision is thus made, according to the present invention, for the cross-sectional area of the at least one ground electrode 15 to increase toward outer rim 10 of housing 5, as illustrated in the front view of FIG. 1. As illustrated in FIG. 1, ground electrode 15 is configured trapezoidally toward outer rim 10. This trapezoidal shape results in a region 50 of continuous change in cross-section for ground electrode 15. In addition, the change in cross-section may also be configured in stepped fashion in a defined region 55 of ground electrode 15, as illustrated in FIG. 4 as dashed lines.

Figure 3:
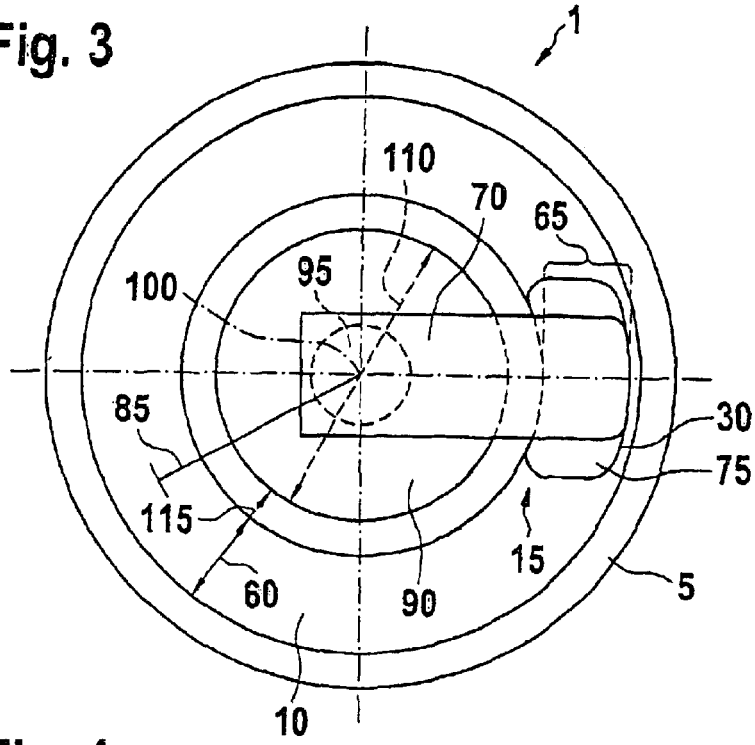
FIG. 3 is a plan view of the first exemplary embodiment of the spark plug according to the present invention.
Figure 4:
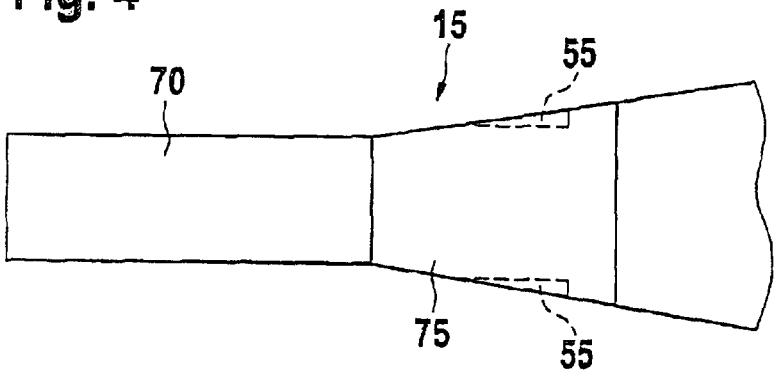
FIG. 4 is a side view of a ground electrode of the spark plug of the first exemplary embodiment.

In general, the change in cross-section of ground electrode 15 may be configured either only continuously as illustrated in FIG. 1, or only in stepped fashion, or both continuously and in stepped fashion, as illustrated, e.g., in FIG. 4. Width 65 of ground electrode 15 in the region of outer rim 10 is illustrated in the plan view of FIG. 3. Also illustrated in FIG. 3 is width 60 of outer rim 10 of housing 5. As illustrated in FIG. 3, the enlargement in cross-sectional area of ground electrode 15 toward outer rim 10 is effected such that width 65 of ground electrode 15 in the region of outer rim 10 does not exceed width 60 of outer rim 10. The result of the enlargement of the cross-sectional area of ground electrode 15 is instead that ground electrode 15, in the region of its attachment to outer rim 10, assumes radius 85 of outer rim 10 of tubular housing 5, and thus extends along the circumference of outer rim 10. Attachment of ground electrode 15 to outer rim 10 is generally accomplished using a welded joint. As illustrated in FIG. 3, ground electrode 15 extends in the region of outer rim 10 over approximately one-eighth of the circumference of outer rim 10 in the direction of the annular outer rim 10, outer rim 10 of course also being coaxial with longitudinal axis 100 of spark plug 1.

The smaller the surface area of ground electrode 15, the less heat ground electrode 15 absorbs. The greater the cross-sectional area of ground electrode 15, the better it dissipates the heat absorbed by ground electrode 15. The enlargement of the cross-sectional area of ground electrode 15 may occur in the direction toward outer rim 10, so that the absorbed heat may be conducted with as little resistance as possible to the relatively cold housing 5 of spark plug 1. A favorable ratio between the surface area of ground electrode 15 and the cross-sectional area of ground electrode 15 may be obtained if ground electrode 15 has a round cross-sectional area. With no change in the planar area of the cross-sectional area of ground electrode 15, this may result in the smallest possible surface area for the ground electrode.

As already described, width 65 of ground electrode 15 in the region of outer rim 10 is limited to width 60 of outer rim 10. If ground electrode 15 nevertheless has a greater width than width 60 of outer rim 10, ground electrode 15 may then-be tapered by plastic deformation (for example by being pressed) to the requisite width 60 of outer rim 10 in the region of its attachment to outer rim 10, in the case of a welded join in the region of the weld root.

Additionally or alternatively, width 60 of outer rim 10 may also be widened to no more than the internal sealing seat diameter 110 of housing 5, as is indicated by the prolongation (depicted with a dashed line) of width 60 of outer rim 10 in FIG. 3. The dashed-line prolongation bears the reference character 115. Sealing seat diameter 110 indicates the minimum diameter of tubular metallic housing 5 of spark plug 1 that occurs at the point within housing 5 at which insulator 90 rests on an annular protrusion of housing 5.

If an adaptation of the width of ground electrode 15 to the width of outer rim 10 may be necessary, this may therefore be accomplished either by reducing the width of ground electrode 15 or by enlarging the width of outer rim 10 or by both reducing the width of ground electrode 15 and enlarging the width of outer rim 10 in the region of the join between ground electrode 15 and outer rim 10.

If the cross-sectional area of ground electrode 15 is round, as described above, it may be equipped with a planar surface in the region of the spark gap that forms between center electrode 95 and ground electrode 15, in order to make the largest possible combustion area available. The planar surface may be impressed onto ground electrode 15 on its region facing toward end surface 105 of center electrode 95. This region is labeled in FIG. 2 with the reference character 120.

Figure 8:
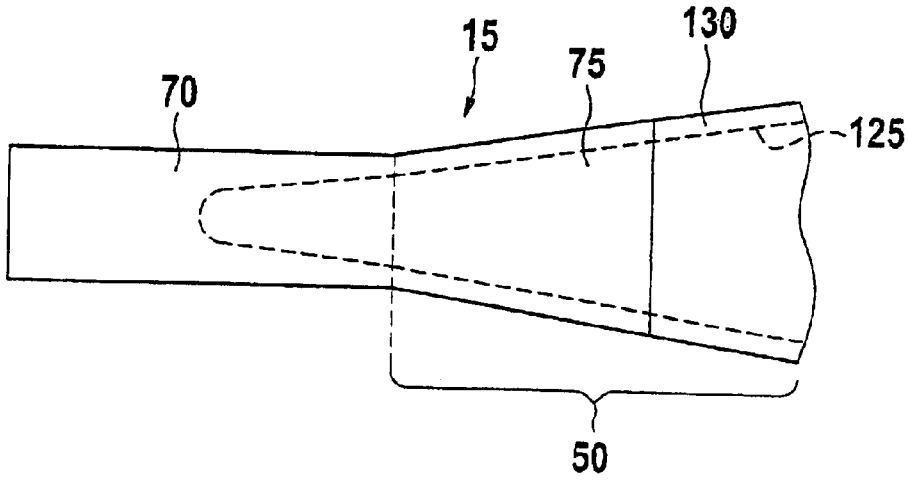
FIG. 8 is plan view of a ground electrode of the spark plug according to the present invention.

As a further measure to reduce the temperature level of ground electrode 15, provision may be made for ground electrode 15 to encompass at least one core 125 that is surrounded by a shell 130 of ground electrode 15 and is more thermally conductive than shell 130. A ground electrode of this kind is illustrated in FIG. 8. Core 125 may be made, for example, of copper, whereas shell 130 may be made, e.g., from a nickel alloy. Ground electrode 15 is thus embodied as a two-material ground electrode. Core 125 may be introduced into shell 130, for example, by cold extrusion.

Figure 5A:
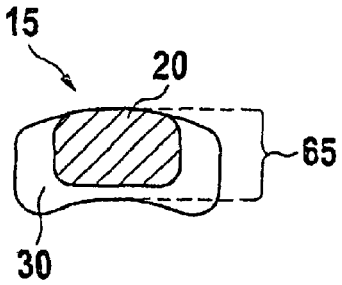
FIG. 5*a* is a first cross-sectional view of the ground electrode of the first exemplary embodiment of the spark plug according to the present invention.
Figure 5B:
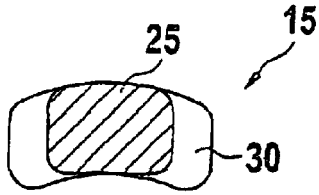
FIG. 5*b* is a second cross-sectional view of the ground electrode of the first exemplary embodiment of the spark plug according to the present invention.

One approach to the manufacture of ground electrode 15 that is particularly simple in terms of design lies in fabricating the ground electrode from two parts 70, 75. As illustrated in FIGS. 1, 2, 3, and 4, a first part is labeled with the reference character 70, and a second part with the reference character 75. It is illustrated in particular in FIGS. 1 and 4 that first part 70 encompasses a substantially constant cross-sectional area. Second part 75, on the other hand, encompasses a cross-sectional area that increases toward outer rim 10 of housing 5. Alternatively, provision may be made for both first part 70 and second part 75 each to encompass a cross-sectional area that increases toward outer rim 10 of housing 5. This is indicated in FIGS. 5*a* and 5*b*. In FIG. 5*a*, a first cross-sectional area of first part 70 is cross-hatched and labeled with the reference character 20, and is of approximately rectangular shape. First cross-sectional area 20 is spaced the farthest away from outer rim 10. It is much smaller than a third cross-sectional area 30 of second part 75 in the region of the join between ground electrode 15 and outer rim 10.

Figure 5C:
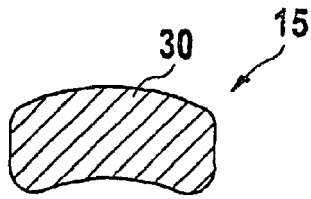
FIG. 5*c* is a third cross-sectional view of the ground electrode of the first exemplary embodiment of the spark plug according to the present invention.

As illustrated in FIG. 5*b*, a second cross-sectional area 25 of first part 70 is depicted with cross-hatching and is approximately rectangular in shape, second cross-sectional area 25 being located closer to outer rim 10 than first cross-sectional area 20, and also being larger than first cross-sectional area 20. Second cross-sectional area 25 is however, still smaller than third cross-sectional area 30. FIG. 5*c* illustrates a cross-section of ground electrode 15 in the region of third cross-sectional area 30, i.e., in the region of the join between ground electrode 15 and outer rim 10. Third cross-sectional area 30 may be adapted to the annular shape of outer rim 10, as is illustrated in FIG. 3 and FIG. 5*c*. FIGS. 5*a*, 5*b*, and 5*c* thus illustrate an example having a first part 70 and a second part 75 that differ from one another in the shape of their cross-sectional area. Provision may also be made, however, for the cross-sectional areas of first part 70 and second part 75 to have the same shape. In particular, both first part 70 and second part 75 may assume a cross-section in the shape of an annular segment having the radius of outer rim 10. Any desired shapes may be used for the cross-sectional areas of first part 70 and second part 75, both when the same shape is used for the cross-sectional areas of the two parts 70, 75 and when different cross-sectional area shapes are used for the two parts 70, 75. In the latter case, any desired combinations of angular, round, or elliptical cross-sectional areas may then be provided for the two parts 70, 75.

FIGS 5*a* and 5*b* illustrate, as described, a first part 70 which has a cross-sectional area that tapers with increasing distance from outer rim 10. As illustrated in FIG. 4, second part 75 has a cross-sectional area that tapers with increasing distance from outer rim 10. As an alternative to this, second part 75 may also encompass a cross-sectional area that is constant over its length, but that may be larger than the largest cross-sectional area of first part 70 in order to ensure the best possible thermal conductivity from ground electrode 15 to housing 5.

In general, a first part 70 having a cross-sectional area that is constant over its length may be combined with a second part 75 having a cross-sectional area that is constant over its length or that becomes larger toward outer rim 10. Correspondingly, a first part 70 having a cross-sectional area that becomes larger over its length toward outer rim 10 may be combined with a second part 75 having a cross-sectional area that is constant over its length or that becomes larger toward outer rim 10. The taper of the cross-sectional area with increasing distance from outer rim 10 may be effected, both for first part 70 and for second part 75, in stepped form, in conical form, in trapezoidal form, or in any other form. The manners described above in which the cross-sectional area tapers with increasing distance from outer rim 10 may also be combined with one another in any desired manner for the two parts 70, 75.

As illustrated in FIGS. 1, 2, 3, and 4, second part 75 is positioned between first part 70 and outer rim 10 of housing 5. In the exemplary embodiment described, first part 70 encompasses a cross-sectional area that is constant over its length, whereas second part 75 encompasses a cross-sectional area that tapers trapezoidally over its length with increasing distance from outer rim 10, which as illustrated with dashed lines in FIG. 4 may additionally encompass stepped region 55 for cross-sectional area reduction with increasing distance from outer rim 10. Second part 75 may be attached to outer rim 10 of housing 5, for example, by welding. First part 70 may be welded onto second part 75. As illustrated in FIG. 3, in the region of its attachment to outer rim 10 second part 75 assumes radius 85 of outer rim 10, and in the region of its attachment to outer rim 10 extends over approximately one-eighth of the circumference of outer rim 10, and is adapted in its base outline to the annular outer rim 10.

Figure 6:
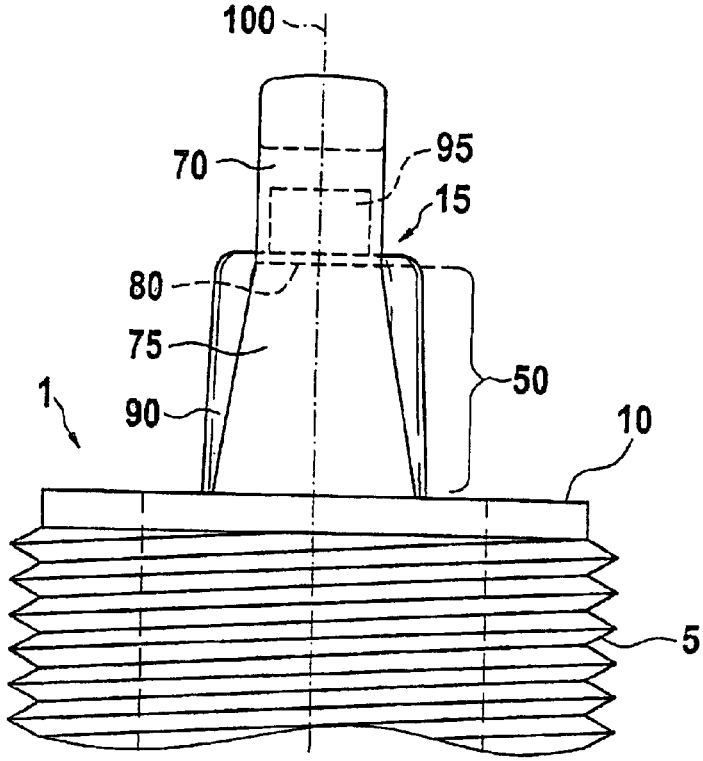
FIG. 6 is a front view of a second exemplary embodiment of a spark plug according to the present invention.
Figure 7:
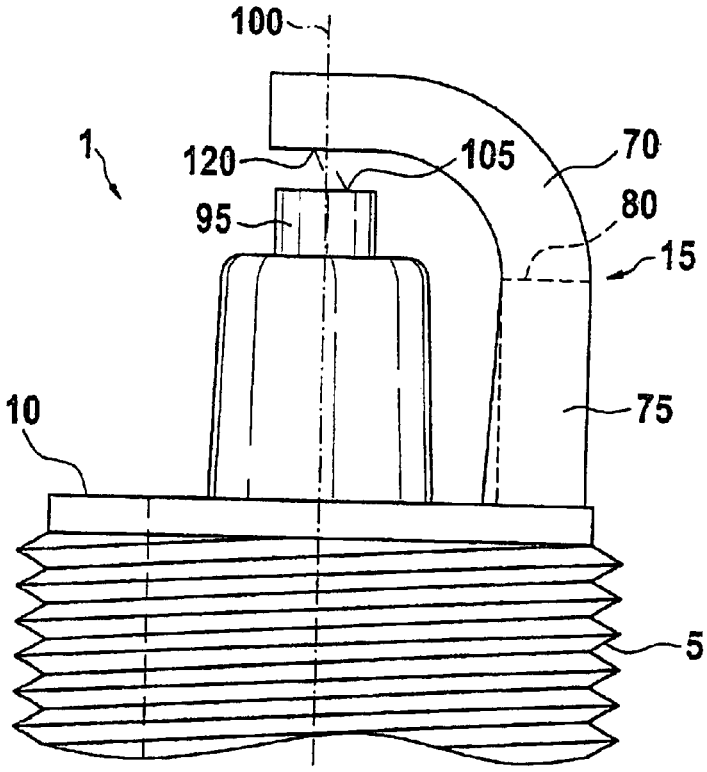
FIG. 7 is a side view of the second exemplary embodiment of the spark plug according to the present invention.

As an alternative to welding of first part 70 onto second part 75, second part 75 may, as illustrated in FIGS. 6, 7, and 8 (in which identical reference characters designate the same elements as in the previous Figures), be equipped, parallel to longitudinal axis 100, with an opening 80 through which first part 70 is guided and extends at a maximum as far as outer rim 10. First part 70 and second part 75 are joined nonpositively or positively to one another, for example, by welding, and are attached onto outer rim 10 of housing 5, for example, by welding. The heat flux may thus be brought with less thermal resistance from first part 70 into the colder housing 5 of spark plug 1, e.g., if first part 70 extends as far as outer rim 10. Otherwise the assemblage of FIGS. 6 and 7 corresponds to the assemblages illustrated in FIGS. 1 and 2. FIGS. 6 and 7 describe a second exemplary embodiment that is characterized by first part 70 inserted into opening 80 of second part 75. Second part 75 may, for example, once again be tapered trapezoidally in its cross-sectional area over its length with increasing distance from outer rim 10, whereas first part 70 may be constant in cross-sectional area over its length, as illustrated in FIG. 6. Second part 75 may also, in the region of its attachment to outer rim 10 of housing 5, assume radius 85 of housing 5 as illustrated in FIG. 3, and may extend there over as much as one-eighth of the circumference of outer rim 10 and may be adapted to the annular shape of outer rim 10.

FIG. 8 illustrates the use of core 125 having a thermal conductivity greater than that of shell 130. The core as illustrated in FIG. 8 may extend over the entire length of second part 75 and additionally over a portion of the length of first part 70. FIG. 8 illustrates an example in which the cross-sectional area of first part 70 does not change over its length, whereas the cross-sectional area of second part 75 tapers trapezoidally with increasing distance from outer rim 10 and thus toward first part 70.

Figure 9A:
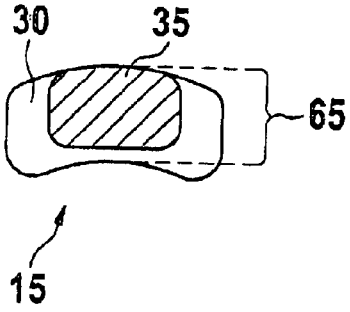
FIG. 9*a* is a first cross-sectional view of the ground electrode of the second exemplary embodiment of the spark plug.
Figure 9B:
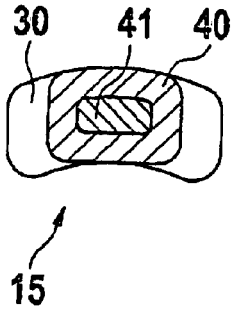
FIG. 9*b* is a second cross-sectional view of the second exemplary embodiment of the ground electrode of the spark plug according to the present invention.

FIGS. 9*a* and 9*b* illustrate, proceeding therefrom, an example in which the cross-sectional area of first part 70 also tapers with increasing distance from outer rim 10. In FIG. 9*a*, a fourth cross-sectional area of first part 70 is illustrated with cross-hatching and labeled with the reference character 35. This fourth cross-sectional area 35 is approximately rectangular in shape, and is so distant from outer rim 10 of housing 5 that it intersects only surrounding shell 130. The reference character 30, as in FIG. 5*a*, designates third cross-sectional area 30 of second part 75 in the region of the attachment of second part 75 to outer rim 10. Third cross-sectional area 30 may be much larger than fourth cross-sectional area 35.

Figure 9C:
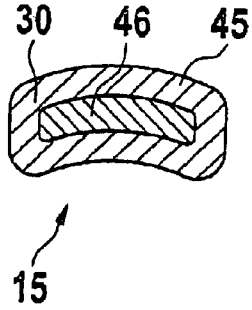
FIG. 9*c* is a third cross-sectional view of the ground electrode of the second exemplary embodiment of a spark plug according to the present invention.

FIG. 9*b* illustrates a fifth cross-sectional area of first part 70 that is closer to outer rim 10 than fourth cross-sectional area 35, and intersects both surrounding shell 130 and core 125. It therefore encompasses a first part 40 of surrounding shell 130 and a second part 41 of core 125. The fifth cross-sectional area, with first part 40 and second part 41, is larger overall than fourth cross-sectional area 35, since in this exemplary embodiment first part 70 becomes larger in its cross-sectional area toward outer rim 10. Also illustrated in FIG. 9*b* is third cross-sectional area 30, which may be even bigger than the fifth cross-sectional area. FIG. 9*c* illustrates third cross-sectional area 30, which is here made up of a first part 45 of surrounding shell 130 and a second part 46 of core 125.

Pure silver or pure nickel may be used as the material for second part 75. Alternatively, alloys having aluminum, silver, copper, magnesium, and nickel as principal constituents may be used for second part 75.

First part 70 and second part 75 may be fabricated from the same material. Ground electrode 15 having the two parts 70, 75 may be fabricated in one piece. Fabrication may be accomplished, for example, by stamping or by cold extrusion.

Provision may also be made for second part 75 not to be welded onto outer rim 10 of housing 5. Housing 5 may be fabricated initially with an extension beyond outer rim 10 at the combustion-chamber end that is removed by metal cutting except for a ridge of, for example, approximately one-eighth of the circumference of outer rim 10, or that may be brought by stamping into one of the shapes described above. The ridge of housing 5 formed in this fashion, which protrudes beyond outer rim 10 in the combustion chamber, then forms second part 75 onto which first part 70 is welded as the actual ground electrode. The ground electrode length is thereby shortened, thus resulting in a reduction in ground electrode temperature. In this case second part 75 is configured integrally with housing 5.

Figure 2:
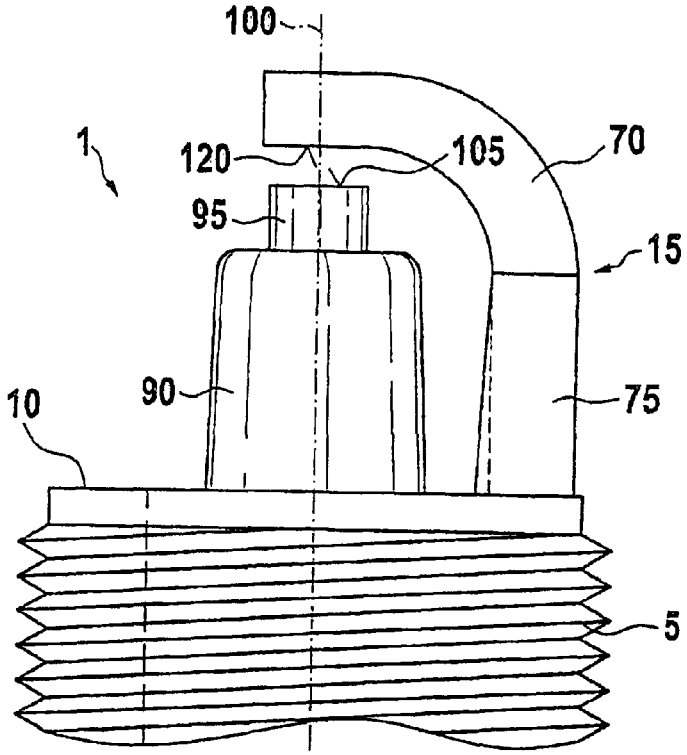
FIG. 2 is a side view of the first exemplary embodiment of the spark plug according to the present invention.

Spark plug 1 may have multiple ground electrodes that may each be configured in accordance with one of the exemplary embodiments described. Multiple identical ground electrodes, and/or multiple differently configured ground electrodes, may be provided. Only one of these ground electrodes may, in this context, be configured as a top electrode as illustrated in FIGS. 2 and 7.

What is claimed is:

1. A spark plug comprising:

a tubular metallic housing having an outer rim at a combustion-chamber end; and at least one ground electrode positioned on the out rim;

wherein a cross-sectional area of the at least one ground electrode increases toward the outer rim of the housing.

2. The spark plug according to claim 1, wherein the at least one ground electrode encompasses a region of continuous change in cross-section.

3. The spark plug according to claim 1, wherein the spark plug encompasses a region having a stepped change in cross-section.

4. The spark plug according to claim 1, wherein the ground electrode encompasses a core that is more thermally conductive than a shell of the ground electrode surrounding the core.

5. The spark plug according to claim 1, wherein the cross-sectional area of the ground electrode, in region of attachment onto the outer rim of the housing, is reduced in width to a width of the outer rim.

6. The spark plug according to claim 1, wherein a width of the outer rim of the housing is enlarged to a width of a cross-section of the ground electrode in a region of attachment of the ground electrode onto the outer rim of the housing.

7. The spark plug according to claim 1, wherein the ground electrode includes a round cross-sectional area.

8. The spark plug according to claim 1, wherein the ground electrode encompasses a first part and a second part each having a cross-sectional area increasing toward the outer rim of the housing.

9. The spark plug according to claim 8, wherein the second part is positioned between the first part and the outer rim of the housing.

10. The spark plug according to claim 8, wherein the second part is positioned on outer rim of the housing and has an opening through which the first part is guided.

11. The spark plug according to claim 1, wherein the ground electrode encompasses a first part having a substantially constant cross-sectional area and a second part having a cross-sectional area increasing toward the outer rim of the housing.

12. The spark plug according to claim 11, wherein the second part is positioned between the first part and the outer rim of the housing.

13. The spark plug according to claim 11, wherein the second part is positioned on the outer rim of the housing and encompasses an opening through which the first part is guided.

14. The spark plug according to claim 13, wherein the first part is guided as far as the outer rim of the housing.

15. The spark plug according to claim 11, wherein the second part includes a trapezoidal configuration and, in a region of the outer rim of the housing, assumes a radius of the housing.

16. The spark plug according to claim 11, wherein the second part is formed only of one of Ag and Ni.

17. The spark plug according to claim 11, wherein the second part is formed of an alloy having at least one of Al, Ag, Cu, Mg and Ni as principal constituents.

18. The spark plug according to claim 11, wherein the first part and the second part are formed from a same material.

19. The spark plug according to claim 11, wherein the ground electrode with the first part and the second part is produced in one piece.

20. The spark plug according to claim 19, wherein the ground electrode is formed by one of punching and cold extrusion.

21. The spark plug according to claim 11, wherein the second part is configured integrally with the housing.

22. The spark plug according to claim 11, wherein the cross-sectional area of the first part and the second part differ in shape.

23. The spark plug according to claim 11, wherein the cross-sectional area of the first part and the second part have a same shape.

* * * * *